US005622519A

United States Patent [19]

Bixler et al.

[11] Patent Number: 5,622,519

[45] Date of Patent: Apr. 22, 1997

[54] RETENTION SYSTEM FOR ELECTRICAL CONNECTORS ON PRINTED CIRCUIT BOARDS

[75] Inventors: Craig Bixler, Elmhurst; Michael O'Sullivan, Willowbrook; David R. Schmidgall, Streamwood, all of Ill.

[73] Assignee: MOLEX Incorporated, Lisle, Ill.

[21] Appl. No.: 430,983

[22] Filed: Apr. 28, 1995

[51] Int. Cl.[6] ..... H01R 13/00

[52] U.S. Cl. ..... 439/570; 439/83; 439/571

[58] Field of Search ..... 439/570, 571, 439/572, 607, 83

[56] References Cited

U.S. PATENT DOCUMENTS

| | | | |
|---|---|---|---|
| 3,803,533 | 4/1974 | Taplin | 439/571 |
| 4,009,921 | 3/1977 | Narozny . | |
| 4,509,811 | 4/1985 | Amano et al. . | |
| 4,629,278 | 12/1986 | Norton et al. . | |
| 4,645,287 | 2/1987 | Olsson . | |
| 4,721,473 | 1/1988 | DelGuidice et al. | 439/79 |
| 4,907,987 | 3/1990 | Douty et al. | 439/571 |
| 5,037,323 | 8/1991 | Locati | 439/374 |
| 5,074,807 | 12/1991 | Parmer | 439/571 |
| 5,145,386 | 9/1992 | Berg et al. | 439/83 |
| 5,171,165 | 12/1992 | Hwang | 439/571 |
| 5,181,318 | 1/1993 | Janota et al. | 29/882 |
| 5,186,654 | 2/1993 | Enomoto et al. | 439/570 |
| 5,228,870 | 7/1993 | Gorenc et al. | 439/571 |
| 5,232,379 | 8/1993 | Lai | 439/570 |
| 5,269,694 | 12/1993 | Kachlic et al. | 439/79 |
| 5,281,165 | 1/1994 | McCleerey et al. | 439/510 |
| 5,331,513 | 7/1994 | Hirai et al. | 361/760 |
| 5,334,049 | 8/1994 | Kachlic et al. | 439/567 |

FOREIGN PATENT DOCUMENTS 63-116975 7/1988 Japan .

OTHER PUBLICATIONS

Molex Singapore Drawing No. SD 87360–0001, Title: Connector 3–in–1 Combo Wide SCSI/2MM/Power Through–Hole, Sheet 1 of 3.

Molex Singapore Drawing No. SD 87360–0001, Title: Connector 3–in–1 Combo Wide SCSI/2MM/Power Through–Hole, Sheet 2 of 3.

*Primary Examiner*—Gary E. Elkins

*Attorney, Agent, or Firm*—Charles S. Cohen

[57] ABSTRACT

A retention system is provided for an electrical connector mountable to a substrate such as a printed circuit board. A dielectric housing has electrical terminals mounted therein, and the housing is adapted for mounting on a surface of the circuit board with the terminals establishing electrical connection to appropriate circuits on the board. The housing includes at least one mounting portion projecting generally parallel to the board in proximity to the surface thereof. A generally U-shaped hold-down clip has a bight portion spanning proximal ends of a pair of leg portions. The leg portions are configured for depending generally along opposite sides of the mounting portion of the housing, with feet portions at distal ends of the leg portions for surface mounting to the surface of the printed circuit board. A complementary interengaging retaining system is provided between the bight portion of the hold-down clip and the mounting portion of the housing for retaining the clip thereon.

18 Claims, 6 Drawing Sheets

RETENTION SYSTEM FOR ELECTRICAL CONNECTORS ON PRINTED CIRCUIT BOARDS

FIELD OF THE INVENTION

This invention generally relates to the art of electrical connectors and, particularly, to a retention system for retaining an electrical connector on a substrate such as a printed circuit board.

BACKGROUND OF THE INVENTION

It is well known to provide electrical connectors mountable to a printed circuit board, with contact terminals therein electrically coupled to respective electrical circuit traces on the board. The terminals may have solder tails projecting from the connector and inserted into holes in the board, or the terminals may have leg portions generally parallel to the board for surface mounting in electrical engagement with circuit traces on the board. In either instance, the terminals are coupled to the circuit traces on the board most commonly by solder connections, either between the solder tails and plated through-holes in the board or between the surface mounted leg portions and the circuit traces on the board surface.

One of the problems with electrical connectors mounted to printed circuit boards is that the electrical connections between the contact terminals and the board circuits often are subjected to stresses which can weaken or destroy the electrical connections. This is particularly true with a common type of electrical connector mountable to printed circuit boards, wherein the connector is elongated in configuration to provide one or more rows of contact terminals.

Surface-mounted electrical connectors most often have some form of hold-down means for securing the connector to a surface of the printed circuit board. The hold-down means may be provided for permanent securement of the connector or for temporarily maintaining the connector on the board. Such hold-down means may be provided by mounting pegs which are integral with the connector housing or by separate hold-down devices or clips. A typical arrangement is to provide the mounting pegs or clips with a bifurcated configuration, along with outwardly projecting hooks or barbs for engaging the opposite surface of the printed circuit board, whereby the pegs or clips can be yieldingly inserted through holes in the board and snappingly engage the opposite side of the board to hold the connector onto the one surface of the board.

Other hold-down means have been provided in the form of screws, bolts or other clamping devices. However, with the ever-increasing miniaturization of electronic circuitry, along with the consequent reduction in sizes of the connectors and terminals, such clamping devices often are impractical and neither cost nor space effective. Consequently, various types of clips or brackets have been used which, themselves, may be secured to the surface of the printed circuit board by a substantial soldered area. Most such clips or brackets are mounted onto the outside of an electrical connector and often provide support between the connector and the printed circuit board in a direction transversely of the elongated connector. However, in compact electronic environments, exterior brackets or mounting clips are difficult to assemble to the connector and do not provide sufficient support between the connector and the printed circuit board in the longitudinal direction of the connector. This invention is directed to solving the problems set forth above by providing a retention system wherein one or more retention members are easily mounted on the connector from the outside thereof and which provide support between the connector and the printed circuit board particularly longitudinally of the elongated connector.

SUMMARY OF THE INVENTION

An object, therefore, of the invention is to provide a new and improved retention system for an electrical connector mountable to a substrate such as a printed circuit board.

In the exemplary embodiment of the invention, a dielectric connector housing has electrical terminals mounted therein. The housing is adapted for mounting on a surface of the printed circuit board with the terminals establishing electrical connection to appropriate circuit means on the board. The housing includes at least one mounting portion projecting generally parallel to the board in proximity to the surface thereof. A generally U-shaped hold-down clip has a bight portion spanning proximal ends of a pair of leg portions. The leg portions are configured for depending generally along opposite sides of the mounting portion of the housing, with feet portions at distal ends of the leg portions for surface mounting to the surface of the printed circuit board. Complementary interengaging retaining means are provided between the bight portion of the hold-down clip and the mounting portion of the housing for retaining the clip thereon.

As disclosed herein, the hold-down clip is a unitary component stamped and formed of sheet metal material. The feet portions of the clip are generally planar for surface connection to the circuit means on the board.

In one embodiment of the invention, the mounting portion of the housing includes a gusset joining the mounting portion with a body portion of the housing. The gusset includes a groove for receiving the bight portion of the hold-down clip. As disclosed herein, the bight portion includes a cut-out area adapted to embrace the gusset and project into the groove.

In another embodiment of the invention, the mounting portion of the housing includes a clip-receiving slot generally parallel to the circuit board for receiving at least the bight portion of the hold-down clip. The bight portion includes a tongue for interference fitting into a recess adjacent the slot; an aperture through which an independent mounting post can be inserted; and an offset tab receivable in a channel interiorly of the slot to prevent lateral movement of the clip.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
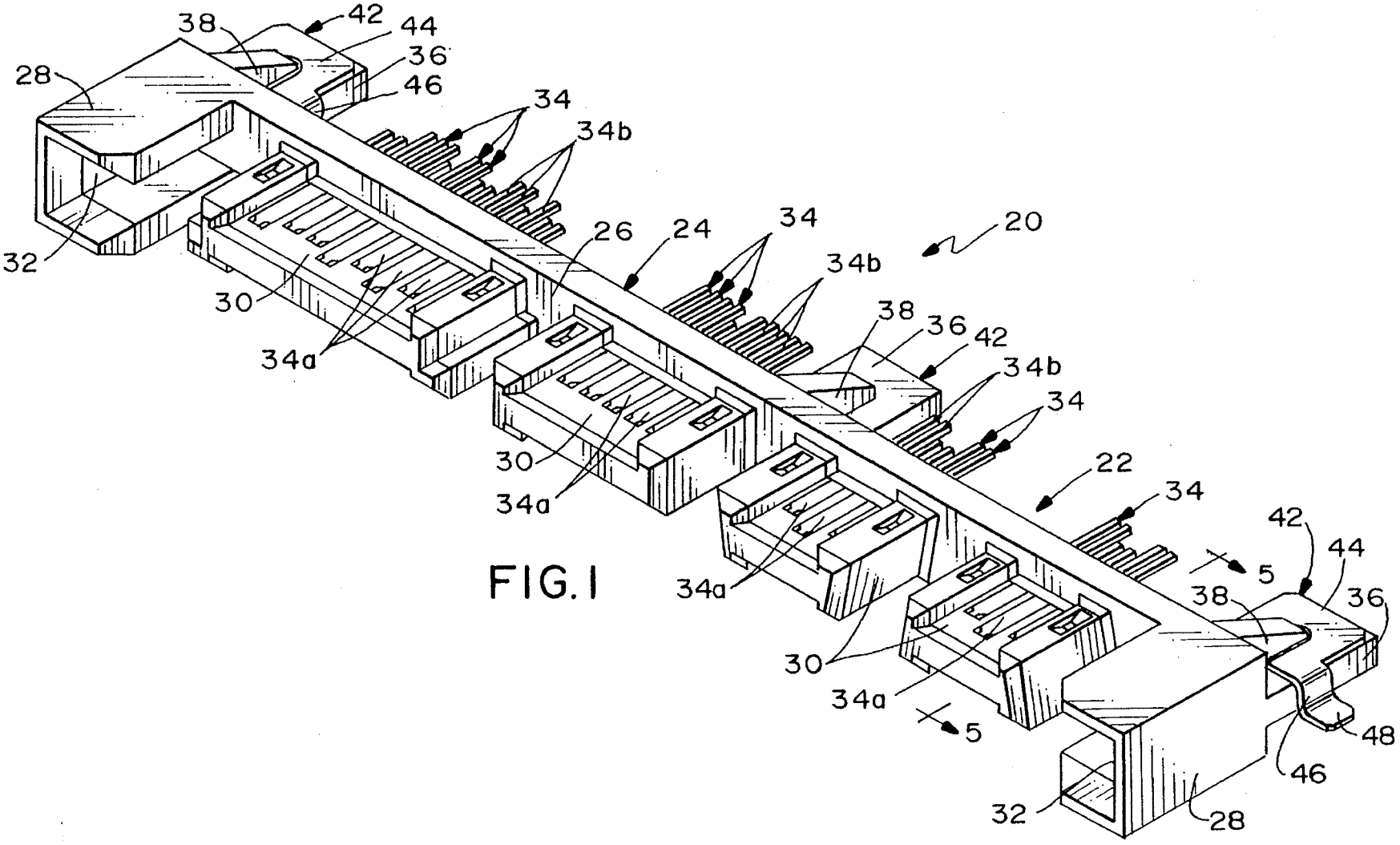
FIG. 1 is a perspective view of an elongated electrical connector incorporating one embodiment of the retention system of the invention.

Referring to the drawings in greater detail, FIGS. 1–6 show one embodiment of the retention system of the invention, and FIGS. 7–14 show a second embodiment of the retention system. The embodiment of FIGS. 1–6 first will be described, followed by a description of the embodiment shown in FIGS. 7–14.

Figure 2:
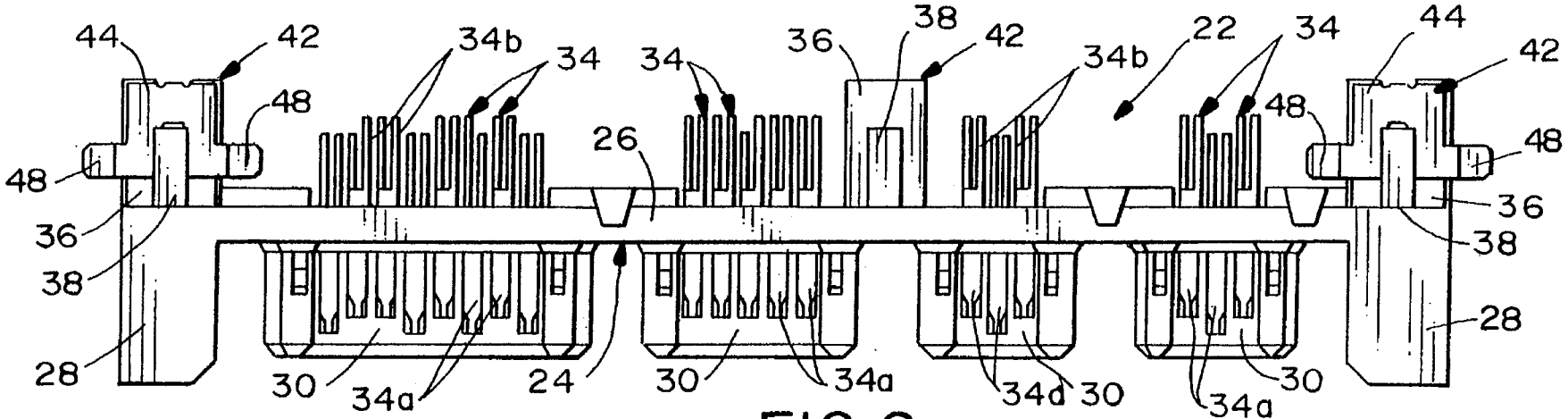
FIG. 2 is a top plan view of the connector of FIG. 1.
Figure 3:
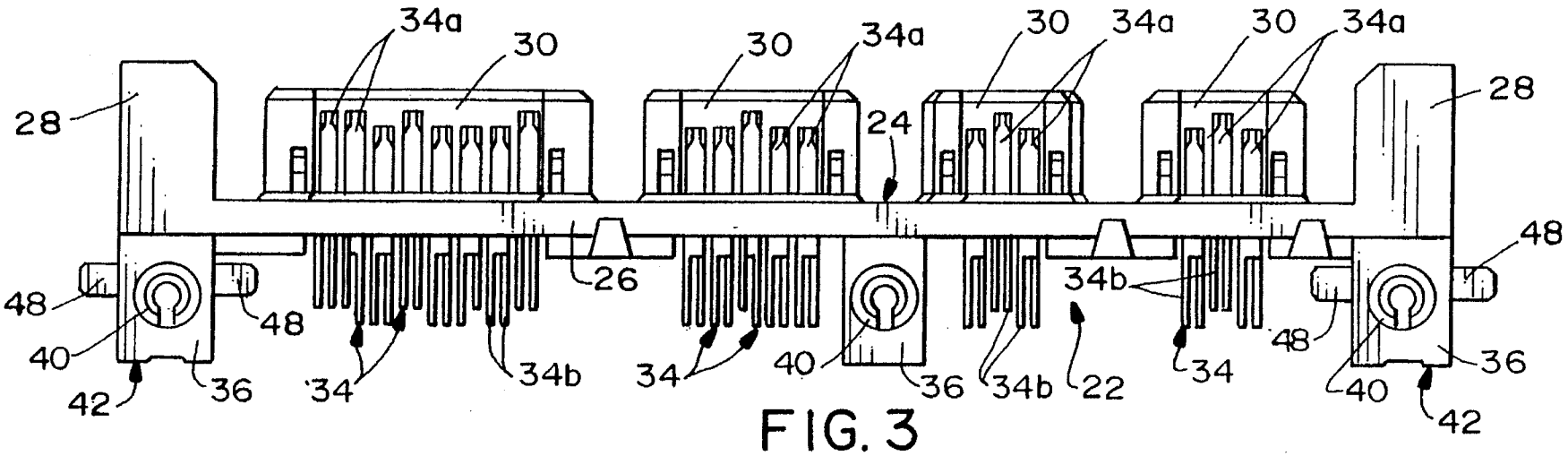
FIG. 3 is a bottom plan view of the connector of FIG. 1.
Figure 6:
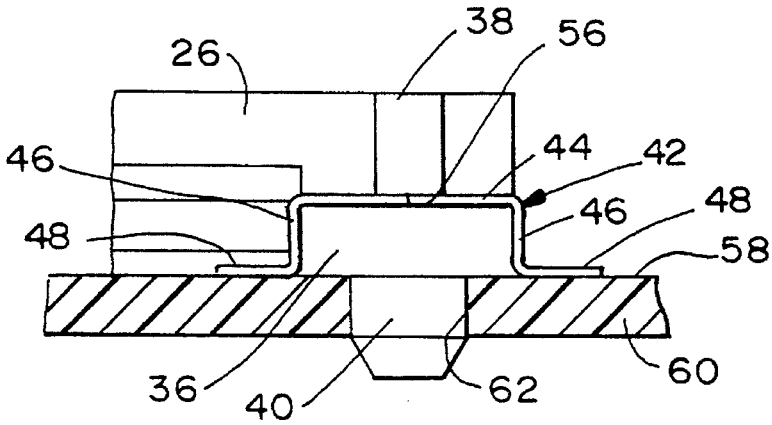
FIG. 6 is a fragmented elevational view looking in the direction of line 6—6 of FIG. 5 with the hold-down clip inserted into the housing.

Referring first to FIGS. 1–3, the invention is incorporated in a retention system, generally designated 20, for an electrical connector, generally designated 22, which is adapted for mounting to a substrate such as a printed circuit board 60 (FIG. 6). The connector is elongated and includes a dielectric housing, generally designated 24, which has an elongated flange or body portion 26 extending between a pair of end guide portions 28 projecting forwardly of body portion 26. A plurality of mating portions 30 also project forwardly of body portion 26. The mating portions are adapted for mating with a complementary connector (not shown) which has a mating end for insertion into channels 32 of guide portions 28.

A plurality of terminals, generally designated 34, are mounted through body portion 26. Each terminal includes a contact end **34*a* on one or the other side of one of the mating portions 30 within cavity 30*a* and a tail end 34*b* projecting rearwardly of body portion 26** for surface mounting on the printed circuit board to establish electrical connection to appropriate circuit means on the board.

A plurality of mounting portions or ears 36 project rearwardly of body portion 26 and are joined to the body portion by triangulated gussets 38. The mounting ears are generally flat and extend generally parallel to the printed circuit board in proximity to the mounting surface thereof. A mounting peg 40 (FIG. 3) projects downwardly from each mounting ear 36 for insertion into appropriate mounting holes in the printed circuit board 60 in order to accurately position and retain the connector 22 on the board prior to soldering. The entire connector housing 24, including flange or body portion 26, receiver portions 28, mounting ears 36, gussets 38 and mounting pegs 40, is unitarily molded of dielectric material such as plastic or the like.

The invention contemplates the provision of a hold-down clip, generally designated 42, embracing each mounting ear 36 to hold connector 22 onto the mounting surface of the printed circuit board. More particularly, referring to FIG. 4 in conjunction with FIGS. 1–3, each hold-down clip 42 is generally U-shaped as defined by a bight portion 44 spanning proximal ends of a pair of leg portions 46. The leg portions are configured for depending along opposite sides of a respective one of the mounting ears 36 as best seen in FIGS. 1 and 6. Generally planar feet portions 48 project outwardly from leg portions 46 for surface connection to mounting pads on the printed circuit board. A slot 50 is formed in a forward edge 52 of bight portion 44, and the slot has inwardly directed barbs 54 for skiving into the plastic material of one of the gussets 38 at one of the mounting ears 36, as will be seen hereinafter. Each hold-down clip 42 is a unitary component of stamped and formed sheet metal material.

Figure 4:
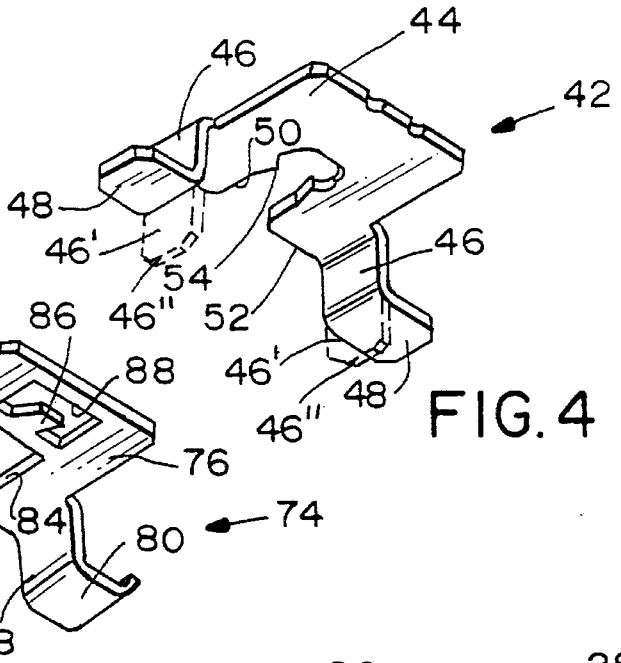
FIG. 4 is a bottom perspective view of one of the hold-down clips.
Figure 13:
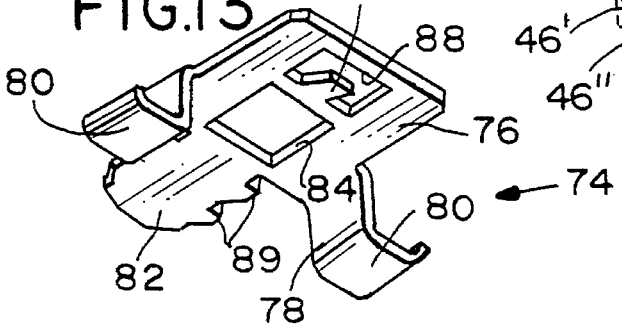
FIG. 13 is a bottom perspective view of the hold-down clip of the second embodiment.
Figure 5:
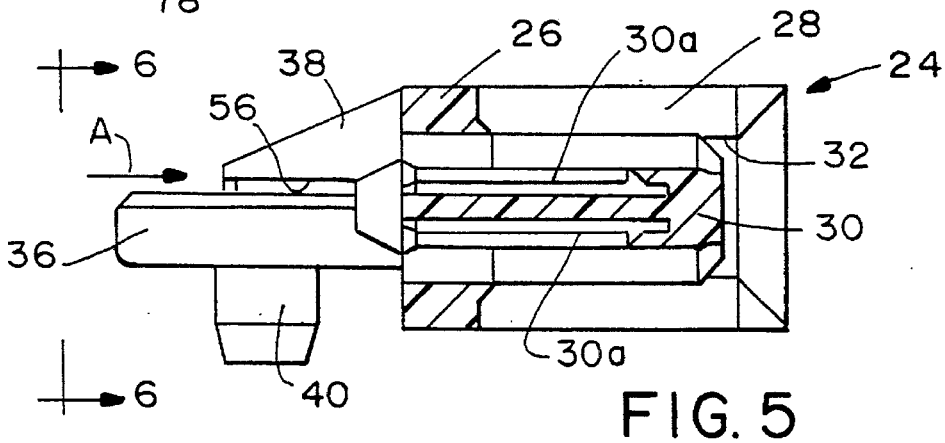
FIG. 5 is a vertical section taken generally along line 5—5 of FIG. 1, with the hold-down clip removed to facilitate the illustration.

FIG. 5 shows one of the mounting ears 36 (the mounting ear at the right-hand end of the connector in FIG. 2) projecting rearwardly of body portion 26 and joined to the body portion by generally triangular gusset 38. It can be seen that a groove 56 is formed in the gusset immediately above the top surface of mounting ear 36. This groove is sized and configured for receiving one of the mounting clips 42 (FIG. 4) in the direction of arrow "A" (FIG. 5). In essence, groove 50 in bight portion 44 of the mounting clip embraces gusset 38 within groove 56, as barbs 54 skive into the plastic material of the gusset within the groove. At the groove, the gusset is just slightly wider than the thickness of the sheet metal material of the clip at the bight portion thereof.

FIG. 6 shows how bight portion 44 of each hold-down clip 42 rests on top of its mounting ear 36, with leg portions 46 of the clip depending along opposite sides of the mounting ear, and with feet portions 48 of the clip in engagement with a top surface 58 of a printed circuit board 60. The feet may be soldered to mounting pads on the top surface of the board. Mounting peg 40 projects through an appropriate mounting hole 62 in the board. Through such a configuration, the mounting ear is secured under the clip 42 while the gusset is secured to the clip.

Figure 7:
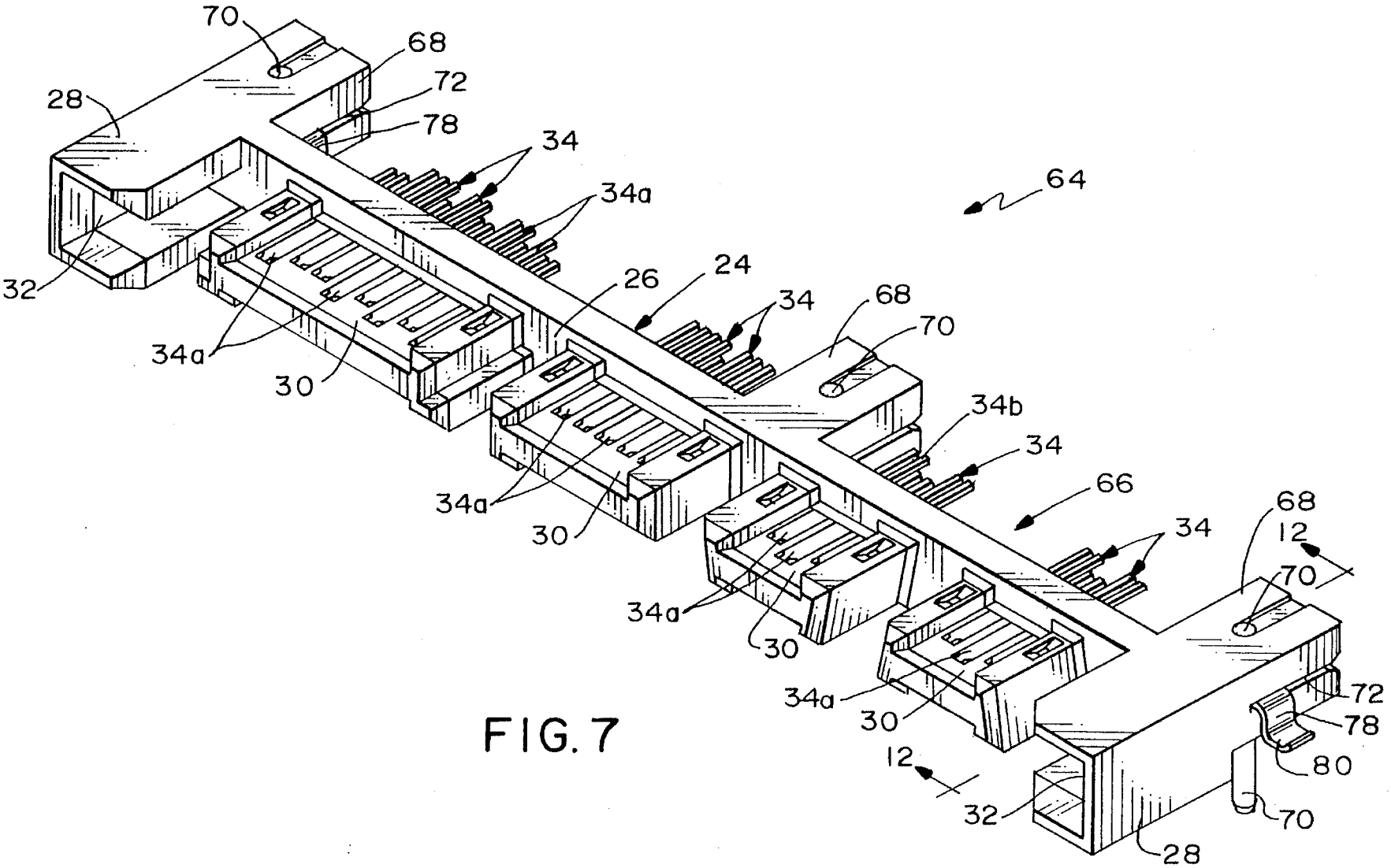
FIG. 7 is a perspective view of an elongated electrical connector incorporating a second embodiment of the invention.
Figure 9:
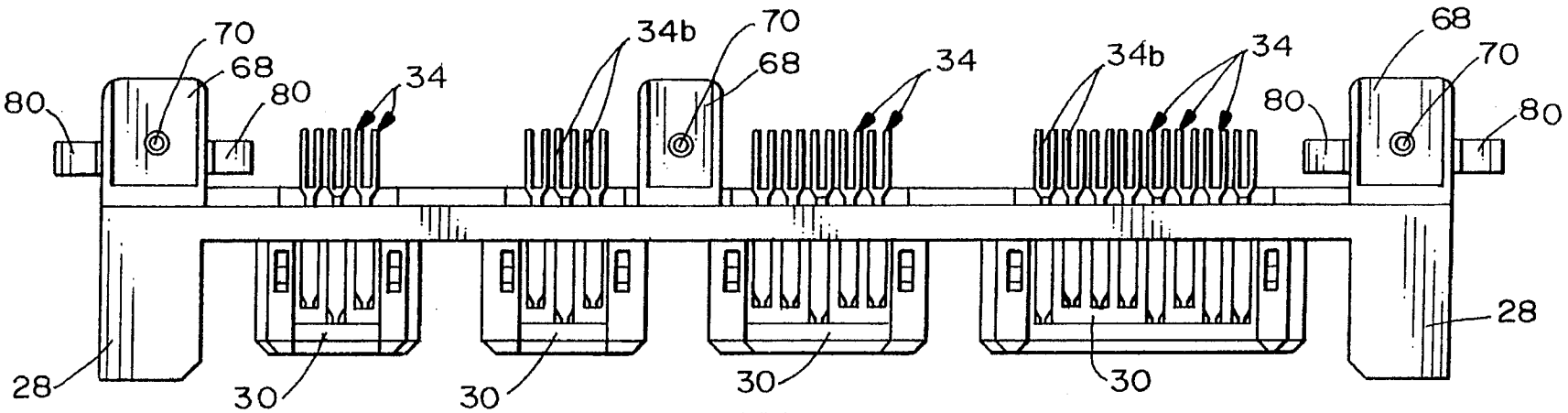
FIG. 9 is a bottom plan view of the connector of FIG. 7.
Figure 8:
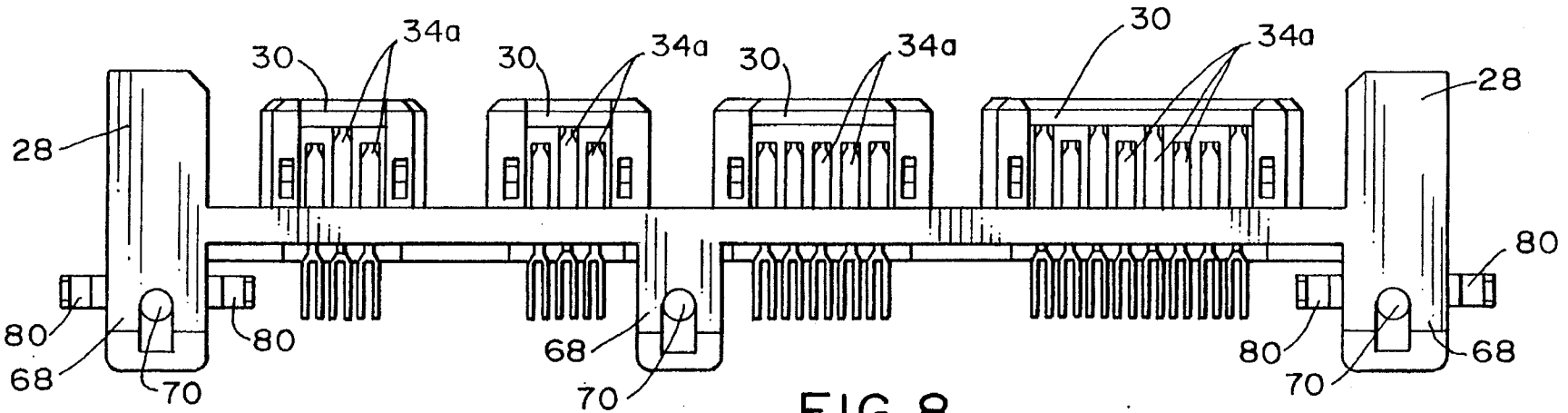
FIG. 8 is a top plan view of the connector of FIG. 7.

Referring to FIGS. 7–9, a second embodiment of a retention system, generally designated 64, includes an elongated electrical connector 66 which is substantially identical to connector 22 of system 20 in FIGS. 1–3. The differences between the two systems reside in the mounting ears and hold-down clips. Therefore, like numerals have been applied in FIGS. 7–9, and 12 to designate like components of connector 66 which correspond to those components already described above in relation to connector 22. In particular, connector 66 includes an elongated dielectric housing, generally designated 24, with flange or body portion 26, guide portions 28 including channels 32, mating portions 30 and terminals 34 including contact ends **34*a* and tails 34*b***.

System 64 in FIGS. 7–14 includes a plurality of mounting portions or ears 68 projecting rearwardly of body portion 24. Separate mounting posts 70, such as of metal, extend downwardly through the mounting ears. Each mounting ear includes a slot 72 (FIGS. 7, 12 and 14) extending substantially thereinto from the rear of the connector for receiving a hold-down clip, generally designated 74 in FIGS. 10 and 11. A recess 73 of reduced width is located at the inner end of slot 72 and extends into a portion of body 26. A channel 90 is located in the lower surface of slot 72. Only two hold-down clips are shown in FIGS. 7–9, at opposite ends of the connector housing although a third clip could be attached to the central ear 68.

Figure 10:
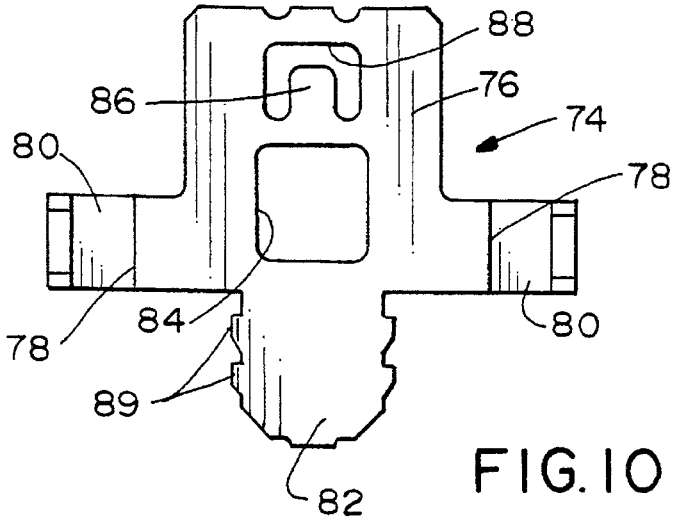
FIG. 10 is a top plan view of one of the hold-down clips for the connector of FIG. 7.
Figure 11:
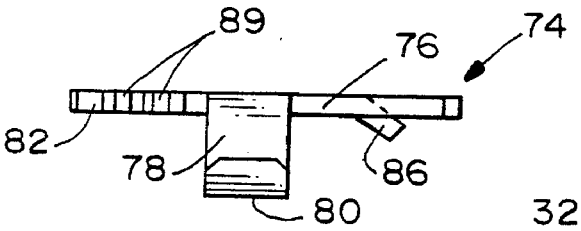
FIG. 11 is a side elevational view of the hold-down clip looking toward the right-hand side of FIG. 10.
Figure 14:
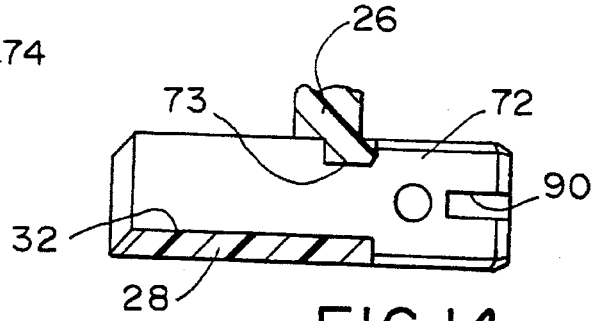
FIG. 14 is a fragmented horizontal section taken generally along line 14—14 of FIG. 12 with the hold-down clip and mounting post removed to facilitate the illustration.
Figure 12:
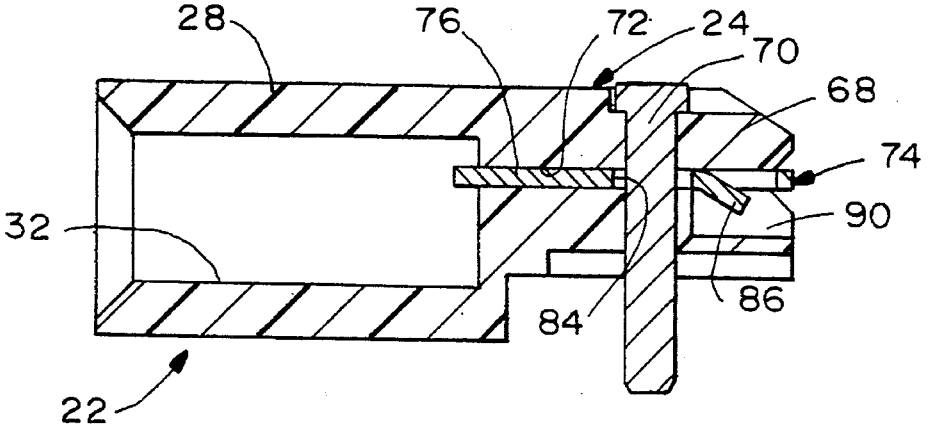
FIG. 12 is a vertical section taken generally along line 12—12 of FIG. 7.

Referring to FIGS. 10–12 in conjunction with FIGS. 7–9, each hold-down clip 74 is generally U-shaped as defined by a bight portion 76 spanning proximal ends of a pair of leg portions 78 configured for depending along opposite sides of a respective one of the mounting ears 68 similar to mounting clips 42 in the embodiment of FIGS. 1–6. Also like clips 42, hold-down clips 74 include generally planar feet portions 80 for surface connection to mounting pads on the printed circuit board. The differences in mounting clip 74 are that bight portion 76 includes (1) a forwardly projecting tongue 82, (2) a centrally located aperture 84 and (3) a tab 86 which is offset from bight portion 76 by bending the tab out of an opening 88 such that the tab is offset from the plane of the bight portion as seen best in FIG. 11. Barbs 89 are stamped out of the edges of tongue 82.

Referring to FIG. 10–14, it can be seen that bight portion 76 of hold-down clip 74 has been inserted into slot 72 of mounting ear 68. Tongue 82, and particularly barbs 89 of the tongue, skive into the plastic material of a recess 73 to retain the clip on ear 68 while offset tab 86 depends downwardly into a channel 90 (FIG. 12). The width of the channel is just slightly greater than the width of the offset tab to prevent lateral (longitudinal of the connector) movement of the clip. Mounting post 70 then is inserted downwardly through aperture 84 in the bight portion of the clip. Once the hold-down clip is positioned as shown in FIG. 12, feet 80 of the clip are soldered to the mounting pads on the printed circuit board. In the alternative, if desired, tongue 82 and barbs 89 could be eliminated. In order to retain the clip within the mounting ear, the aperture 84 would be dimensioned to approximately the same size as the diameter of mounting post 70. Accordingly, upon inserting the post, the clip would be secured to the housing.

A further alternative configuration of leg portions 46 is shown in phantom in FIG. 4. Rather than bending the end of the leg portions to create feet portions 48, the leg portion could extend in a straight manner as indicated at 46' so that the end 46" of such leg portion may extend into a hole. In the alternative, the leg portion may extend through the hole and then be bent or otherwise deformed at an angle to leg portion 46 (such as to a shape similar to foot portion 48) and, if desired, subsequently soldered.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A retention system for an electrical connector mountable to a substrate such as a printed circuit board, comprising:

a dielectric housing having terminal receiving cavities therein, a plurality of terminals mounted in said cavities, the housing being adapted for mounting on a surface of the board with the terminals establishing electrical connection to appropriate circuit traces on the board, and the housing including an elongated body portion and at least one rearwardly projecting mounting portion projecting generally parallel to the board in proximity to said surface, said mounting portion including a gusset joining the mounting portion with the elongated body portion, said gusset including a groove;

a generally U-shaped hold-down clip mounted on the mounting portion of the housing and having a bight portion spanning proximal ends of a pair of leg portions, the leg portions being configured for depending generally along opposite sides of said mounting portion of the housing with end portions of the leg portions for mounting to said printed circuit board, said bight portion engaging the groove of the gusset to retain the clip on the housing.

2. The retention system of claim 1 wherein said end portions of the hold-down clip comprise substantially planar surface mount feet for surface connection to the surface of said printed circuit board.

3. The retention system of claim 2 wherein said hold-down clip comprises a unitary component of stamped and formed sheet metal material.

4. The retention system of claim 1 wherein said bight portion of the hold-down clip includes a cut-out area adapted to embrace the gusset and project into the groove.

5. A retention system for an electrical connector mountable to a substrate such as a printed circuit board, comprising:

an elongated dielectric housing having opposite ends and an elongated body portion extending therebetween with electrical terminal means mounted on the body portion, the housing including at least one forwardly projecting mating portion with the housing being adapted for mounting on a surface of the printed circuit board with the terminal means establishing electrical connection to appropriate circuit traces on the board, and the housing including a mounting portion at each opposite end thereof projecting rearwardly therefrom generally parallel to the board in proximity to said surface, each said mounting portion including a gusset joining the mounting portion with the body portion;

a generally U-shaped hold-down clip of stamped and formed sheet metal material mounted on each mounting portion of the housing, each hold-down clip having a bight portion spanning proximal ends of a pair of leg portions, the leg portions being configured for depending generally along opposite sides of the respective mounting portions of the housing with end portions of the leg portions for mounting to said printed circuit board; and complementary interengaging retaining means between the bight portion of the hold-down clip and said mounting portion of the housing for retaining the clip thereon, said complementary interengaging retaining means includes bight portion of each hold-down clip, the gussets and a groove in each said gusset for receiving the bight portion of the respective hold-down clip.

6. The retention system of claim 5 wherein said bight portion of the respective hold-down clip includes a cut-out area adapted to embrace the gusset and project into the groove.

7. The retention system of claim 5 wherein each said end portion includes a generally planar surface mount foot for mounting to the surface of said printed circuit board.

8. The retention system of claim 5 wherein each said end portion extends into a hole in said printed circuit board.

9. The retention system of claim 8 wherein said bight portion of the hold-down clip includes a tongue for interference fitting into a recess in said housing.

10. The retention system of claim 8 wherein said bight portion of the hold-down clip includes an aperture through which an independent mounting post can be inserted.

11. The retention system of claim 8 wherein said bight portion of the hold-down clip includes an offset tab receivable in a channel located interiorly of said slot to prevent lateral movement of the clip.

12. A retention system for an electrical connector mountable to a substrate such as a printed circuit board, comprising:

a dielectric housing having terminal receiving cavities therein, a plurality of terminals mounted in said cavities, the housing being adapted for mounting on a surface of the board with the terminals establishing electrical connection to appropriate circuit traces on the board, and the housing including at least one rearwardly projecting mounting portion projecting generally parallel to the board in proximity to said surface, said mounting portion including a clip-receiving slot generally parallel to the board;

a generally U-shaped hold-down clip mounted on the mounting portion of the housing and having a bight portion spanning proximal ends of a pair of leg portions, the leg portions being configured for depending generally along opposite sides of said mounting portion of the housing with end portions of the leg portions for mounting to said printed circuit board, and at least the bight portion of the hold-down clip being received in the clip-receiving slot of the mounting portion; and complementary interengaging retaining means between the bight portion of the hold-down clip and said mounting portion of the housing for retaining the clip thereon.

13. A retention system for an electrical connector mountable to a substrate such as a printed circuit board, comprising:

an elongated dielectric housing having opposite ends and an elongated body portion extending therebetween with electrical terminal means mounted on the body portion, the housing including at least one forwardly projecting mating portion with the housing being adapted for mounting on a surface of the printed circuit board with the terminal means establishing electrical connection to appropriate circuit traces on the board, and the housing including a mounting portion at each opposite end thereof projecting rearwardly therefrom generally parallel to the board in proximity to said surface, each mounting portion of the housing includes a clip-receiving slot generally parallel to the board;

a generally U-shaped hold-down clip of stamped and formed sheet metal material mounted on each mounting portion of the housing, each hold-down clip having a bight portion spanning proximal ends of a pair of leg portions, the leg portions being configured for depending generally along opposite sides of the respective mounting portions of the housing with end portions of the leg portions for mounting to said printed circuit board, at least the bight portion of each hold-down clip being received in a respective one of said clip-receiving slots in said mounting portions; and complementary interengaging retaining means between the bight portion of the hold-down clip and said mounting portion of the housing for retaining the clip thereon.

14. The retention system of claim 13 wherein said bight portion of the hold-down clip includes a tongue for interference fitting into a recess adjacent an end of said slot.

15. The retention system of claim 13 wherein said bight portion of the hold-down clip includes an aperture through which an independent mounting post can be inserted.

16. The retention system of claim 13 wherein said bight portion of the hold-down clip includes an offset tab receivable in a channel oriented generally transverse to a longitudinal axis of said housing and located in a surface of said slot to prevent lateral movement of the clip.

17. A right angle electrical connector mountable to a circuit member and mateable with a mating electrical component along a mating axis, comprising:

an elongated dielectric housing having an elongated body portion, said body portion having a front mating end, a rear termination end, and opposite sides, a mounting portion generally adjacent each said opposite side and extending rearwardly from said body portion along said mating axis, said mounting portion including a generally flat lower surface adapted to be positioned generally parallel to and adjacent a mounting surface of said circuit member, said flat lower surface being generally parallel to said mating axis;

a plurality of electrical terminals extending through said body portion, each terminal including a contact section projecting from said body portion and generally parallel to said mating axis, and a rear termination section for establishing an electrical connection to an appropriate circuit trace of said circuit member;

a generally U-shaped hold-down clip of stamped and formed sheet metal material mounted on each mounting portion of the housing, each hold-down clip having a bight portion extending between proximal ends of a pair of leg portions, the leg portions being configured for depending generally along opposite sides of the respective mounting portions of the housing with distal end portions of the leg portions adapted for mounting to said circuit member; and complementary interengaging retaining means between each hold-down clip and said housing for retaining the clip on a respective one of said mounting portions.

18. The right angle electrical connector of claim 17 wherein said body portion is generally planar and said mounting portions extend along axes that are generally perpendicular to the plane of said body portion.

* * * * *